United States Patent [19]

Kelly

[11] Patent Number: 4,742,196

[45] Date of Patent: May 3, 1988

[54] ELONGATE PRESSURE-ACTUATED ELECTRICAL SWITCH

[75] Inventor: David I. Kelly, Wrexham, Wales

[73] Assignee: BICC Public Limited Company, London, England

[21] Appl. No.: 98,503

[22] Filed: Sep. 18, 1987

[30] Foreign Application Priority Data

Sep. 19, 1986 [GB] United Kingdom ..... 8622644

[51] Int. Cl.[4] ..... H01H 3/16

[52] U.S. Cl. ..... 200/86 R; 200/85 R; 340/666

[58] Field of Search ..... 361/395, 398, 399; 340/665, 666, 667, 933; 174/29, 115; 307/119; 200/159 B, 5 R, 5 A, 86 R, 86 A, 85 R, 85 A, 86.5, 61.19, 61.41, 333, 275

[56] References Cited

U.S. PATENT DOCUMENTS

| | | | |
|---|---|---|---|
| 3,398,397 | 8/1968 | O'Connell | 200/86 R |
| 3,748,373 | 7/1973 | Remy | 174/115 |
| 3,778,805 | 12/1973 | Gould | 200/86 R |
| 3,876,844 | 4/1975 | Scherenberg | 200/86 R |
| 4,060,705 | 11/1977 | Peachey | 200/85 R |
| 4,172,216 | 10/1979 | O'Shea | 200/86 R |
| 4,268,714 | 5/1981 | Mori | 174/115 |
| 4,551,713 | 11/1985 | Aossey | 200/86 R |
| 4,617,433 | 10/1986 | Hoshikawa | 200/86.5 |
| 4,649,228 | 3/1987 | Suzuki | 174/115 |

FOREIGN PATENT DOCUMENTS

| | | | |
|---|---|---|---|
| 272893 | 8/1928 | United Kingdom | 200/86 R |

*Primary Examiner*—G. P. Tolin

*Attorney, Agent, or Firm*—Anthony J. Casella; Gerald E. Hespos

[57] ABSTRACT

A simple and inexpensive elongate pressure-actuated electrical switch especially suitable for security purposes comprises a flexible tubular body of insulating material having air within its bore and incorporating at opposed locations around its periphery two sectoral portions of electrically conductive material. Two elongate conductors extend lengthwise in electrical contact with the conductive sectoral portion and two electric conductors extend lengthwise in contact with the conductive sectoral portion. The sectoral portions have a conductivity less than that of the conductors. An overall outer sheath surrounds the tubular body and conductors and has a flat surface which is suitable for supporting the switch on the ground and which is so positioned with respect to the sectoral portions that one conductive sectoral portion is at a position intermediate of the flat surface and the other conductive sectoral portion. When downwardly directed pressure is applied to the sheath the opposed electrically conductive sectoral portions are pressed into contact with one another to effect electrical connection between the conductors.

18 Claims, 2 Drawing Sheets

ELONGATE PRESSURE-ACTUATED ELECTRICAL SWITCH

This invention relates to elongate pressure-actuated electrical switches operable by pressure applied at substantially any position along their lengths.

It is common practice to employ an elongate pressure-actuated electrical switch for security purposes such as the operation of a warning of the entry or approach of an intruder or visitor, the closing or opening of a door, gate or other security barrier, and an alarm switch for operation by employees in banks, post offices or other establishment open to the public where there is a risk of robbery. Many forms of such elongate pressure-actuated electrical switches have been proposed and used for security purposes but many, if not all, of such switches are complicated in form and expensive to manufacture.

It is an object of the present invention to provide a simple and inexpensive elongate pressure-actuated electrical switch which is especially, but not exclusively, suitable for security purposes.

According to the invention, the improved elongate pressure-actuated electrical switch comprises a flexible tubular body of electrically insulating material having within its bore air or other electrically insulating fluid and incorporating at opposed locations around its periphery two sectoral portions of electrically conductive material, each of which sectoral portions extends throughout the radial thickness of the wall of the tubular body; at least one elongate electric conductor which extends lengthwise with respect to and is in electrical contact with one of said electrically conductive sectoral portions and at least one elongate electric conductor which extends lengthwise with respect to and is in electrical contact with the other of said electrically conductive sectoral portions, said electrically conductive sectoral portions having a conductivity less than that of the conductors; and, surrounding the flexible tubular body and elongate conductors, an overall outer switch of electrically insulating material, which overall sheath has at least one substantially flat surface which is suitable for supporting the elongate electrical switch on a surface and which is so positioned with respect to said electrically conductive sectoral portions of the flexible tubular body that one electrically conductive sectoral portion is at a position intermediate of said substantially flat surface of the outer sheath and the other electrically conductive sectoral portion.

The arrangement is such that, when the elongate switch is laid on the ground with the substantially flat surface of its outer sheath in interfacial contact with the surface of the ground, the elongate conductors in electrical contact with the electrically conductive sectoral portions of the flexible tubular body are normally insulated from one another by said air or other electrically insulating fluid within the bore of the flexible tubular body but, when sufficient downwardly directed pressure is applied to the outer sheath, the opposed electrically conductive sectoral portions of the flexible tubular body are pressed into contact with one another to effect electrical connection between the elongate conductor further from said substantially flat surface of the outer sheath and the elongate conductor nearer said substantially flat surface.

Preferably, the electrically conductive sectoral portion of the flexible tubular body which is nearer the substantially flat surface of the outer sheath has two or more than two elongate electric conductors in electrical contact with the sectoral portion at positions spaced peripherally, and preferably uniformly, around the sectoral portion and, in this case, where a single elongate electric conductor is in electrical contact with the electrically conductive sectoral portion of the flexible tubular body which is further from the substantially flat surface of the outer sheath, this conductor is positioned centrally with respect to the elongate conductors in electrical contact with the electrically conductive sectoral portion which is nearer the substantially flat surface of the outer sheath. In a preferred embodiment, each electrically conductive sectoral portion of the flexible tubular body has two or more than two elongate electrical conductors in electrical contact with the sectoral portion at positions spaced peripherally around the sectoral portion and the electrically conductive sectoral portions have in electrical contact with them the same number of elongate electric conductors as one another.

The flexible tubular body preferably has a transverse cross-sectional shape of an elongate form in which the longer side walls of the tubular body constitute said electrically conductive sectoral portions and have outer surfaces which are substantially flat and are substantially parallel to the substantially flat outer surface of the outer sheath.

The overall outer electrically insulating sheath preferably has a transverse cross-sectional shape of an elongate form in which the surface of the sheath remote from said substantially flat surface of the outer sheath is also substantially flat and lies in a plane substantially parallel to said substantially flat surface. The substantially flat surface of the outer sheath remote from the substantially flat surface suitable for supporting the elongate electrical switch on a surface preferably is of narrower width than said substantially flat surface.

The or each elongate electric conductor in electrical contact with an electrically conductive sectoral portion of the flexible tubular body may be wholly or partially embedded in the electrically conductive sectoral portion or may be embedded in the outer sheath and in electrical contact with the outer surface of the electrically conductive sectoral portion.

It will be appreciated that the improved elongate pressure-actuated electrical switch is not restricted to use for security purposes and, by appropriate selection of the transverse cross-sectional shape, thickness and insulating material of the outer sheath, the elongate pressure-actuated electrical switch can be used for road vehicle detection, such as for effecting a survey of the amount of traffic using a particular road, operating traffic signals, operating a warning of the approach of a vehicle, and operating a gate or garage doors.

Where the improved elongate pressure-actuated electrical switch is to be employed in a permanent installation, the substantially flat surface of the outer sheath suitable for supporting the elongate electrical switch on a surface may carry a layer of pressure-sensitive adhesive by means of which the electrical switch can be stuck to said surface or the outer sheath may have, protruding outwardly from one or each side of that part of the sheath having a substantially flat surface suitable for supporting the elongate electrical switch on a surface, a longitudinally extending flange through which the switch can be secured to the floor or other surface by nails, screws or other separately formed securing means.

The flexible tubular body preferably is made of a plastics material and the electrically conductive sectoral portions of the flexible tubular body preferably are made of a graphite loaded plastics material. Each elongate conductor may comprise a plurality of stranded copper wires or a plurality of tinsel conductors. The overall outer sheath is preferably made of polyurethane or other suitable plastics material.

The improved elongate pressure-actuated electrical switch preferably is in the form of an electric cable but, in some circumstances, it may be in the form of a mat. In this latter case, the mat may comprise a single elongate pressure-actuated electrical switch in the form of an electric cable which extends back and forth along the mat in a plurality of runs extending alongside one another; alternatively, the mat may comprise a single elongate pressure-actuated electrical switch having a transverse cross-sectional shape of an elongate form in which the longer sides of the flexible tubular body are very much greater in length than the shorter sides and in which said longer sides each include a plurality of electrically conductive sectoral portions electrically insulated from one another by intervening sectoral portions of electrically insulating material, the electrically conductive sectoral portions of the longer sides being at opposed locations; preferably said intervening opposed electrically insulating sectoral portions are integral with transversely extending webs of electrically insulating material dividing the bore of the flexible tubular body into a plurality of separate longitudinally extending channels.

The invention is further illustrated by a description, by way of example, of three preferred forms of elongate pressure-actuated electrical switch with reference to the accompanying drawings, in which.

Figure 1:
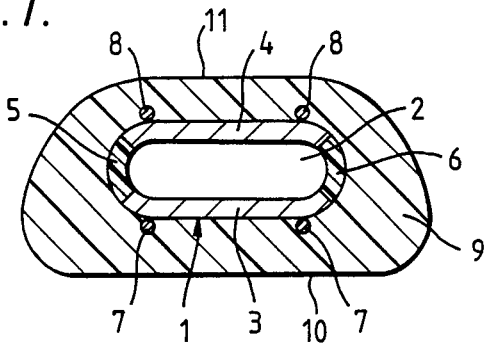
FIG. 1 is a transverse cross-sectional view of a first preferred form of electrical switch drawn on an enlarged scale.

Referring to FIG. 1, the first preferred form of elongate pressure-actuated electrical switch comprises a flexible tubular body 1 which has a transverse cross-sectional shape of an elongate form in which the longer side walls of the tubular body constitute two opposed sectoral portions 3, 4 of a graphite loaded plastics material and have outer surfaces which are substantially flat and are substantially parallel to one another and in which the shorter smoothly curved side walls 5, 6 interconnecting the longer side walls are of electrically insulating plastics material. Each of the electrically conductive sectoral portions 3, 4 extends throughout the radial thickness of the wall of the tubular body 1. The bore 2 of the flexible tubular body 1 is filled with air. Two outer conductors 7 of elongate form, each comprising a plurality of stranded copper wires, extend lengthwise in electrical contact with the flat outer surface of the electrically conductive sectoral portion 3 at positions spaced uniformly along the sectoral portion and two outer conductors 8 of elongate form, each comprising a plurality of stranded copper wires, extend lengthwise in electrical contact with the flat outer surface of the electrically conductive portion 4, the positions of the conductors 8 being directly opposite the conductors 7. The electrically conductive sectoral portions 3, 4 have a conductivity less than that of the conductors 7, 8. The flexible tubular body 1 and the conductors 7, 8 are embedded in an overall outer sheath 9 of electrically insulating plastics material, which sheath has a substantially flat surface 10 which is substantially parallel to the outer surfaces of the sectoral portions 3, 4 and which is suitable for supporting the elongate electrical switch on the ground. The substantially flat surface 10 of the outer sheath 9 is so positioned with respect to the electrically conductive sectoral portions 3, 4 of the flexible tubular body 1 that the sectoral portion 3 is at a position intermediate of the flat surface 10 and the sectoral portion 4. The outer sheath 9 also has a substantially flat surface 11 which is substantially parallel to and of narrower width than the flat surface 10 and which is joined to the flat surface 10 by smoothly rounded surfaces 12.

The elongate pressure-actuated electrical switch has an overall height of 10 mm and a maximum transverse width of 300 mm and is especially suitable for security purposes.

When the elongate switch is laid on the ground with the flat surface 10 of its overall outer sheath 9 in interfacial contact with the surface of the ground, the electrically conductive sectoral portions 3, 4 are normally insulated from one another by the air within the bore 2 of the flexible tubular body 1. When sufficiently downwardly directed pressure is applied by the foot of an operator on the flat surface 11 of the outer sheath 9, the opposed electrically conductive sectoral portions 3, 4 of the flexible tubular body 1 are pressed into contact with one another to effect electrical connection between the elongate conductors 8 and the elongate conductors 7.

Figure 2:
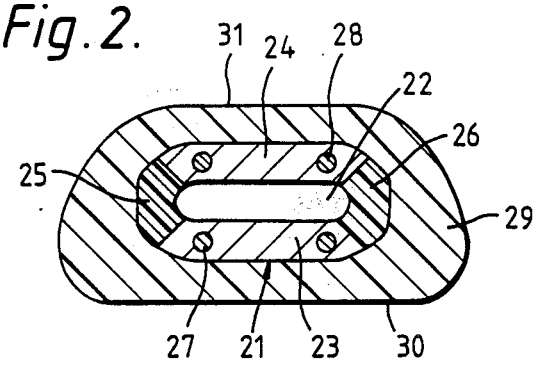
FIG. 2 is a similar view of a second preferred form of electrical switch.

The second preferred form of elongate pressure-actuated electrical switch shown in FIG. 2 is substantially identical with the elongate pressure-actuated electrical switch shown in FIG. 1 with the exception of the position of the elongate conductors and, for convenience, component parts of the electrical switch shown in FIG. 2 are given references greater by twenty than the references of the corresponding parts of the electrical switch shown in FIG. 1. In the electrical switch shown in FIG. 2, the elongate conductors 27 are embedded in the electrically conductive sectoral portion 23 and the elongate conductors 28 are embedded in the electrically conductive sectoral portion 24. The electrical switch shown in FIG. 2 operates in the same manner as that of the electrical switch shown in FIG. 1.

Figure 3:
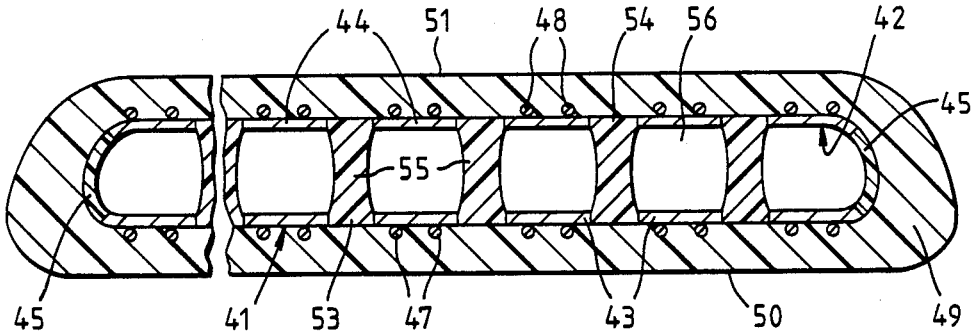
FIG. 3 is a similar view of a third preferred form of electrical switch in the form of a mat.

The third preferred form of elongate pressure-actuated electrical switch shown in FIG. 3 is in the form of a mat for the operation of a warning of the approach of a visitor. The mat comprises a flexible tubular body 41 which has a transverse cross-sectional shape of an elongate form in which the longer sides of the tubular body are substantially parallel with one another and are very much greater in length than the smoothly curved shorter sides. The longer sides of the flexible tubular body 41 each include a plurality of electrically conductive sectoral portions 43, 44 each with two associated elongate electric conductors 47, 48 in electrical contact with the outer surface of the sectoral portion. Adjacent electrically conductive sectoral portions 43 are insulated from one another by intervening sectoral portions 53 of electrically insulating plastics material and adjacent electrically conductive sectoral portions 44 are electrically insulated from one another by intervening sectoral portions 54 of electrically insulating material. The electrically conductive sectoral portions 43, 44 are directly opposite one another and are normally electrically insulated from one another by air within the bore 42 of the flexible tubular body 41. Curved side walls 45 of electrically insulating plastics material electrically insulate adjacent electrically conductive sectoral portions 43, 44. The opposed electrically insulating sectoral portions 53, 54 of electrically insulating plastics material are integral with transversely extending webs 55 of electrically insulating plastics material dividing the bore 42 of the flexible tubular body 41 into a plurality of separate longitudinally extending channels 56, each of which contains air. The flexible tubular body 41 and the elongate electric conductors 47, 48 are embedded in an overall outer sheath 49 of electrically insulating plastics material, which sheath has a substantially flat surface 50 which is substantially parallel to the outer surfaces of the longer sides of the flexible tubular body and which is suitable for supporting the mat on the ground. The flat surface 50 of the outer sheath 49 is so positioned with respect to the electrically conductive sectoral portions 43, 44 of the flexible tubular body 41 that the electrically conductive sectoral portions 43 are at a position intermediate of the flat surface 50 of the outer sheath and the electrically conductive sectoral portions 44. The upper surface 51 of the sheath 49 constituting the upper surface of the mat is also substantially flat and lies in a plane substantially parallel to the flat surface 50 of the outer sheath. The upper flat surface 51 is of narrower width than the flat surface 50 to which it is joined by smoothly rounded side surfaces.

The pressure-actuated electrical switch in the form of a mat has an overall height of 20 mm, a maximum transverse width of 1 meter and a maximum length of 2 meters.

When the mat is laid on the ground with the flat surface 50 of its overall outer sheath 49 in interfacial contact with the surface of the ground, the electrical conductive sectoral portions 43, 44 of the flexible tubular body 41 are normally insulated from one another by the air within the channels 56 of the bore 42 of the flexible tubular body 41. When sufficient downwardly directed pressure is applied to the outer sheath 49 by a person standing on the mat, at least one pair of opposed electrically conductive sectoral portions 43, 44 are pressed into contact with one another to effect electrical connection between their associated elongate conductors 47, 48.

What I claim as my invention is:

1. An elongate pressure-actuated electrical switch comprising a flexible tubular body of electrically insulating material having within its bore air or other electrically insulating fluid and incorporating at opposed locations around its periphery two sectoral portions of electrically conductive material, each of which sectoral portions extends throughout the radial thickness of the wall of the tubular body; at least one elongate electric conductor which extends lengthwise with respect to and is in electrical contact with one of said electrically conductive sectoral portions and at least one elongate electric conductor which extends lengthwise with respect to and is in electrical contact with the other of said electrically conductive sectoral portions, said electrically conductive sectoral portions having a conductivity less than that of the conductors; and, surrounding the flexible tubular body and elongate conductors, an overall outer sheath of electrically insulating material, which overall sheath has at least one substantially flat surface which is suitable for supporting the elongate electrical switch on a surface and which so positioned with respect to said electrically conductive sectoral portions of the flexible tubular body that one electrically conductive sectoral portion is at a position intermediate of said substantially flat surface of the outer sheath and the other electrically conductive sectoral portion.

2. An elongate pressure-actuated electrical switch as claimed in claim 1, wherein the electrically conductive sectoral portion of the flexible tubular body which is nearer the substantially flat surface of the outer sheath has at least two elongate electric conductors in electrical contact with the sectoral portion at positions spaced peripherally around the sectoral portion.

3. An elongate pressure-actuated electrical switch as claimed in claim 2 in which a single elongate electric conductor is in electrical contact with the electrically conductive sectoral portion of the flexible tubular body which is further from the substantially flat surface of the outer sheath, wherein said conductor is positioned centrally with respect to the elongate conductors in electrical contact with the electrically conductive sectoral portion which is nearer the substantially flat surface of the outer sheath.

4. An elongate pressure-actuated electrical switch as claimed in claim 1, wherein each electrically conductive sectoral portion of the flexible tubular body has at least two elongate electric conductors in electrical contact with the sectoral portion at positions spaced peripherally around the sectoral portion, the electrically conductive sectoral portions having in electrical contact with them the same number of elongate electric conductors as one another.

5. An elongate pressure-actuated electrical switch as claimed in claim 1, wherein the flexible tubular body has a transverse cross-sectional shape of an elongate form in which the longer side walls of the tubular body constitute said electrically conductive sectoral portions and have outer surfaces which are substantially flat and are substantially parallel to the substantially flat outer surface of the outer sheath.

6. An elongate pressure-actuated electrical switch as claimed in claim 1, wherein the overall outer electrically insulating sheath has a transverse cross-sectional shape of an elongate form in which the surface of the sheath remote from said substantially flat surface of the outer sheath is also substantially flat and lies in a plane substantially parallel to the said substantially flat surface.

7. An elongate pressure-actuated electrical switch as claimed in claim 6, wherein the substantially flat surface of the outer sheath remote from the substantially flat surface suitable for supporting the elongate electrical switch on a surface is of narrower width than said substantially flat surface.

8. An elongate pressure-actuated electrical switch as claimed in claim 1, wherein the or each elongate electric conductor in electrical contact with an electrically conductive sectoral portion of the flexible tubular body is at least partially embedded in the electrically conductive sectoral portion.

9. An elongate pressure-actuated electrical switch as claimed in claim 1, wherein the or each elongate electric conductor in electrical contact with an electrically conductive sectoral portion of the flexible tubular body is embedded in the outer sheath and in electrical contact with the outer surface of the electrically conductive sectoral portion.

10. An elongate pressure-actuated electrical switch as claimed in claim 1, wherein the substantially flat surface of the outer sheath suitable for supporting the elongate electrical switch on a surface carries a layer of pressure-sensitive adhesive by means of which the electrical switch can be stuck to said surface.

11. An elongate pressure-actuated electrical switch as claimed in claim 1, wherein the outer sheath has, protruding outwardly from at least one side of that part of the sheath having a substantially flat surface suitable for supporting the elongate electrical switch on a surface, a longitudinally extending flange through which the switch can be secured to said surface by separately formed securing means.

12. An elongate pressure-actuated electrical switch as claimed in claim 1, which elongate switch extends back and forth in a plurality of runs extending alongside one another and is a component part of a mat.

13. An elongate pressure-actuated electrical switch as claimed in claim 1, which switch is in the form of a mat and has a transverse cross-sectional shape of an elongate form in which the longer sides of the flexible tubular body are very much greater in length than the shorter sides and in which said longer sides each include a plurality of electrically conductive sectoral portions electrically insulated from one another by intervening sectoral portions of electrically insulating material, the electrically conductive sectoral portions of the longer sides being at opposed locations.

14. An elongate pressure-actuated electrical switch as claimed in claim 13, wherein said intervening opposed sectoral portions of electrically insulating material are integral with transversely extending webs of electrically insulating material dividing the bore of the flexible tubular body into a plurality of separate longitudinally extending channels.

15. An elongate pressure-actuated electrical switch as claimed in claim 1, wherein the flexible tubular body is made of a plastics material and the electrically conductive sectoral portions of the flexible tubular body are made of a graphite loaded plastics material.

16. An elongate pressure-actuated electrical switch as claimed in claim 1, wherein each elongate conductor comprises a plurality of stranded copper wires.

17. An elongate pressure-actuated electrical switch as claimed in claim 1, wherein each elongate conductor comprises a plurality of tinsel conductors.

18. An elongate pressure-actuated electrical switch as claimed in claim 1, wherein the overall outer sheath is made of polyurethane.

* * * * *